US007775741B2

(12) United States Patent
Copoulos

(10) Patent No.: US 7,775,741 B2
(45) Date of Patent: Aug. 17, 2010

(54) APPARATUS AND METHOD FOR SURFACE FINISHING CURED CONCRETE

(76) Inventor: Paul Copoulos, 109 Sunflower Meadows Dr., McDonough, GA (US) 30252

( * ) Notice: Subject to any disclaimer, the term of this patent is extended or adjusted under 35 U.S.C. 154(b) by 0 days.

(21) Appl. No.: 12/411,005

(22) Filed: Mar. 25, 2009

(65) Prior Publication Data

US 2009/0190999 A1 Jul. 30, 2009

Related U.S. Application Data

(63) Continuation of application No. 12/371,049, filed on Feb. 13, 2009, and a continuation-in-part of application No. 11/804,911, filed on May 21, 2007, now Pat. No. 7,530,762, which is a continuation of application No. 60/808,879, filed on May 26, 2006.

(51) Int. Cl.
*B24B 27/033* (2006.01)
*E01C 23/088* (2006.01)

(52) U.S. Cl. ..... 404/112; 404/94

(58) Field of Classification Search ..... 404/94, 404/112; 451/350

See application file for complete search history.

(56) References Cited

U.S. PATENT DOCUMENTS

| | | | | |
|---|---|---|---|---|
| 3,098,329 | A | 7/1963 | Doran | |
| 3,683,761 | A | 8/1972 | Babic | |
| 3,934,377 | A * | 1/1976 | Tertinek | 451/353 |
| 3,936,212 | A | 2/1976 | Holz, Sr. et al. | |
| 4,155,596 | A | 5/1979 | Brejcha | |
| 4,317,314 | A | 3/1982 | Carlstrom et al. | |
| 4,742,652 | A | 5/1988 | Cannan et al. | |
| 5,085,008 | A | 2/1992 | Jennings et al. | |
| 5,454,751 | A | 10/1995 | Wiand | |
| 5,567,503 | A | 10/1996 | Sexton et al. | |
| 5,605,493 | A | 2/1997 | Donatelli et al. | |
| 5,762,545 | A | 6/1998 | Edwards | |
| 5,816,739 | A | 10/1998 | Allen | |
| 5,890,833 | A | 4/1999 | Allen et al. | |
| 5,911,620 | A * | 6/1999 | Spangenberg et al. | 451/548 |
| 6,058,922 | A | 5/2000 | Sexton | |
| 6,299,522 | B1 * | 10/2001 | Lee | 451/548 |
| 6,475,067 | B1 | 11/2002 | Jones et al. | |
| RE38,364 | E | 12/2003 | Wetherell et al. | |
| 6,786,556 | B2 * | 9/2004 | Due | 299/36.1 |
| 6,814,657 | B2 * | 11/2004 | Spangenberg et al. | 451/548 |
| 7,018,132 | B2 | 3/2006 | Ewer et al. | |
| 7,481,602 | B2 * | 1/2009 | Lampley et al. | 404/112 |
| 7,530,762 | B2 | 5/2009 | Reed et al. | |
| 2002/0115396 | A1 | 8/2002 | Sarantitis | |
| 2005/0172428 | A1 * | 8/2005 | Thysell | 15/4 |
| 2005/0175782 | A1 | 8/2005 | Graf | |

(Continued)

*Primary Examiner*—Raymond W Addie
(74) *Attorney, Agent, or Firm*—Williamson Intellectual Property Law, LLC; Thomas R. Williamson, III

(57) ABSTRACT

A method and apparatus for finishing cured concrete floors using a riding trowel to which large diameter pans are rotationally secured, the pans having abraders releasably secured to their undersides. The individual abraders are preferably individually removably secured to the pans by hook-and-loop fasteners, wherein the fasteners are selectively disposed on the flat bottom surfaces of the pans or within shallow depressions in the bottom surfaces of the pans. The riding trowel further comprises a vacuum system in fluid communication with a contained space formed by a shroud having a rigid upper portion and a flexible lower portion where it contacts the finished cured concrete floor surface.

12 Claims, 15 Drawing Sheets

U.S. PATENT DOCUMENTS

2006/0025059 A1 2/2006 Gueorguiev et al.
2006/0034663 A1 2/2006 Lampley et al.
2006/0183334 A1 8/2006 Uhlenbrock et al.
2007/0155285 A1* 7/2007 Padgett et al. ..... 451/5
2009/0156099 A1 6/2009 Copoulos

* cited by examiner

APPARATUS AND METHOD FOR SURFACE FINISHING CURED CONCRETE

CROSS-REFERENCE TO RELATED APPLICATIONS

The present application is a continuation-in-part application to non-provisional patent application Ser. No. 11/804,911, entitled "METHODS AND APPARATUSES FOR SURFACE FINISHING CURED CONCRETE", filed on May 21, 2007 now U.S. Pat. No. 7,530,762 (claiming priority to provisional patent application Ser. No. 60/808,879 filed May 26, 2006), and to non-provisional continuation application Ser. No. 12/371,049, entitled "METHODS AND APPARATUSES FOR SURFACE FINISHING CURED CONCRETE", filed on Feb. 13, 2009, and claims priority thereto and the full benefit thereof, the entire contents of the above applications being hereby incorporated by reference.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to concrete finishing apparatuses and more specifically to a concrete riding trowel and abrading mechanisms therefor.

2. Description of Related Art

Owners of facilities having large concrete floors want the floors to be flat, smooth and glossy. Defects or imperfections in a concrete floor surface are unacceptable to most business proprietors and therefore must be removed. Traditional methods used today to improve a concrete surface typically involve epoxy coating of the fully cured concrete surface, and buffing the concrete surface. Buffing techniques involve very little removal of concrete from the surface of fully cured concrete and therefore imperfections may remain. Grinding of the surface has been employed, however, current practices do not adequately removing certain defects, such as a shoe imprints in the concrete surface, do not produce as flat a surface as the owner may want, cannot be made as flat as desired due to exposing aggregate and take too much time, which is almost always a negative from the owner's viewpoint. Currently concrete finishers use multiple small disks affixed to each of the blades at the base of a troweling machine; the machine applying power causing the blades to rotate such that the abrasive surface of the disks is in contact with the concrete surface. The weight of the machine acting directly upon the grinding disks is used for the application of the downward force acting on the disks. However, even this prior practice does not achieve the desired smooth glossy finish. Application of a water-based surface hardener chemical, such as Diamond Hard marketed by Euclid Chemical Company, followed by polishing with a polishing machine, such as a Tenant polishing machine, has been employed on poured concrete surfaces after the concrete has been allowed to fully cure for 28 days. This last mentioned procedure does produce a somewhat shiny surface but not the degree of gloss desired by the owners of the facilities and it does not remove surface defects or blemishes such as battery acid spills, oil and the like or surface irregularities such as foot prints which may have been pressed into the surface before the concrete had completely cured, and which, if not removed, will adversely affect the surface appearance even though polished.

BRIEF SUMMARY OF THE INVENTION

The herein-disclosed new apparatus technology plus new methods of using this technology includes smoothing a cured concrete floor using a large number of relatively small abraders mounted on a large rotating pan to remove imperfection in the surface without removing an excessive amount of surface material, thereby avoiding contact with large aggregate. By using the herein disclosed flattening and polishing method and apparatus with and without a surface hardener, a surface finish and shine is produced which resembles an automotive painted surface or polished ceramic tile. Achieving such an improved surface finish is accomplished through use of a very large diameter rotating pan having abrasive surface abraders which serve to flatten and polish a hardened concrete floor. A very large diameter pan can be releasably connected to each set of blades of a riding trowel or connected directly to each of its vertical trowel drive shafts.

Customers having merchandise establishments want the surface of their concrete floors to be level, smooth and polished. The riding trowel is typically used to smooth partially-cured large concrete floors. Such machines force course aggregate about on eighth of an inch below the surface of the uncured concrete. The herein-disclosed method and apparatus abrades the surface without exposing course aggregate and polishes the surface of cured concrete to produce a satin shiny finish.

According to its major aspects and broadly stated, the present invention in its preferred form is a concrete finishing apparatus having an annular pan that is removably secured to a plurality of rotating blades of a riding trowel. Each of the blades has a leading edge and the blades rotate around a central axis. The annular pan has a rotational axis that is coaxial with central axis around which the blades rotate.

The annular pan has angle-shaped brackets secured thereon, each of which is dimensioned to receive a leading edge of the blades, thereby removably securing the pan to the blades. The angle-shaped brackets have a horizontal member and the leading edges of the blades are received by the angle-shaped brackets and are disposed in contact with the angle-shaped brackets during rotation of the blades, such that the horizontal member prevents vertical separation of the annular pan from the blades.

An alternate embodiment comprises an abrading apparatus for a concrete finishing trowel comprising a pan secured to blade portions of the concrete finishing trowel, an abrading pad and a fastener, such as, for exemplary purposes only, a hook-and-loop fastener, for removably securing the abrading pad to the pan. A first portion of the hook-and-loop fastener is secured to the pan and a second portion of the hook-and-loop fastener is secured to the abrading pad.

In another alternate embodiment, the annular pan further may selectively comprise a bottom surface with a shallow depression therein, wherein the first portion of the hook-and-loop fastener is secured within the shallow depression. This configuration prevents lateral movement of the abrading pad under forces during abrasion of a concrete surface.

One or more abrading apparatuses are installed on the concrete finishing trowel, wherein the trowel is operated, spinning the abrading apparatuses as described more fully hereinbelow. As the abrading apparatuses are rotated, the abrading pads wear on the concrete surface, providing a desired finish.

In still another alternate embodiment, the concrete finishing trowel comprises a shroud that encloses the abrading apparatuses to form a contained space. The shroud has a rigid upper section and a flexible lower section. The flexible lower section loosely forms a seal against a ground surface during operation of the concrete finishing trowel, thereby reducing the formation of clouds of dust from the detritus formed during abrasion of the concrete surface. In addition to containment by the shroud, the abrading apparatus may further comprise a vacuum system in fluid communication with a contained space within said shroud, thereby removing the abraded dust, passing it through a filter and allowing clean air to exit the filter. In this fashion, dust is minimized, reducing subsequent cleanup and health hazards.

In use, a concrete finishing trowel is obtained that has one or more annular pans rotationally secured thereto, wherein the annular pan comprises one or more abraders removably secured thereon. A concrete surface is subsequently polished by rotation of the annular pans which contact the concrete surface.

The concrete finishing trowel may also comprise a shroud that forms a contained space around the annular pans, and may further comprise a vacuum system to remove detritus formed during abrasion of the concrete surface that is contained within the space enclosed by the shroud, the concrete trowel platform and the concrete surface. The vacuum system has a filter to remove particulates from the air in the contained space.

The shroud has a rigid upper section to facilitate installation of the vacuum tube that provide fluid communication from the vacuum system to the contained space, and a flexible lower section that forms a loose seal against the concrete surface being finished, thereby retaining particulate matter and preventing same from forming clouds of dust particles.

More specifically, the present invention is a concrete finishing apparatus comprising abraders for finishing a concrete surface, the abraders being secured to the bottom surface of one or more annular pans via cooperative hook-and-loop fasteners, such as VELCRO, either directly or within depressions in the bottom surface. First halves of the cooperative hook-and-loop fasteners are secured to the bottom surface of the annular pans, either directly or within the depressions, and second halves of the cooperative hook-and-loop fasteners are secured to the individual abraders. This facilitates ready removal and replacement of the abraders. The use of depressions provides a slight recess for the abraders and improves containment thereof when the abraders subject to lateral forces during concrete finishing operations.

The annular pan is subsequently secured to a riding trowel by interlocking with the blades of the trowel (as discussed hereinabove) to form an abrading mechanism. The trowel will comprise one or more abrading mechanisms. The riding trowel further comprises a shroud having a rigid upper section, constructed from metal, rigid plastic or the like, and a flexible lower section constructed from rubber, flexible plastic or the like. The lower flexible section contacts the concrete surface to be finished, forming a loose seal around a contained space that is enclosed by the platform of the trowel, the shroud and the floor surface. A vacuum system comprising a vacuum motor, a filter and a collection tube is installed on the riding trowel, such that the vacuum hose enters through an aperture in the shroud and is thus in fluid communication with the contained space.

In use, the abraders are removably secured to the bottom surface of the annular pan, either directly on bottom surface or within depressions. One or more annular pans are installed on trowel blades as described more fully hereinabove. The vacuum system applies a vacuum to the contained space within the shroud. The riding trowel is operated on cured concrete surface for finishing by rotation of the annular pans, the abraders of which finish the concrete surface. Debris from the abrasion operation is removed by the vacuum system and is collected in the filter for subsequent disposal.

Various alternate abrading mechanisms are disclosed, such as, for exemplary purposes only, circular abraders, octagonal abraders, removably-secured pan abraders and diamond abraders, all directly driven by the shafts of the riding trowel. Other abrader shapes are envisioned, such as, without limitation, square, triangular and other polygonal-shaped abraders. The bottom surface of these alternate abraders selectively comprises abrader pads secured thereto or exposed impregnated or embedded abrasive material.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS OF THE INVENTION

In describing the preferred and alternate embodiments as illustrated in FIGS. 1-29, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
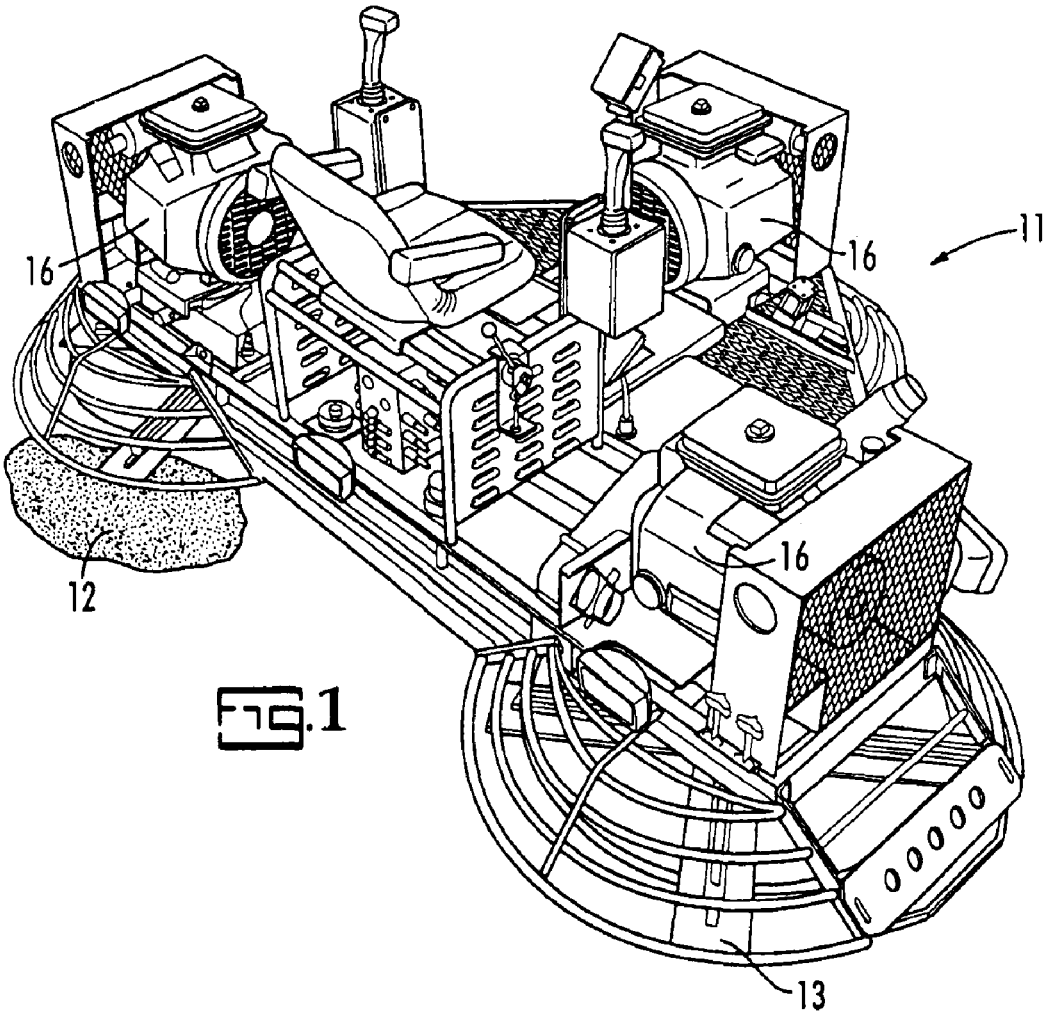
FIG. 1 is a perspective view of a riding trowel.
Figure 2:
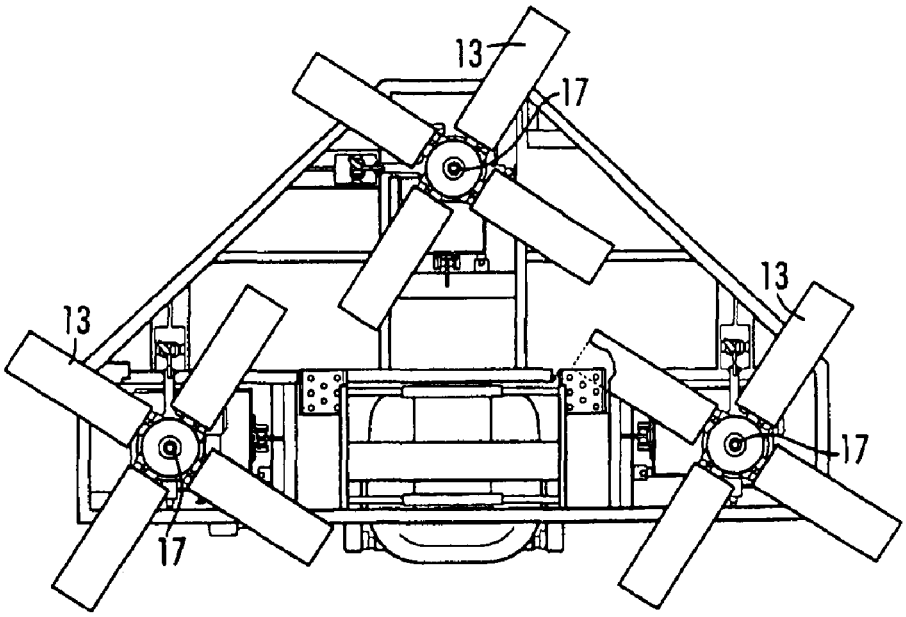
FIG. 2 is a bottom view of the riding trowel of FIG. 1.
Figure 3:
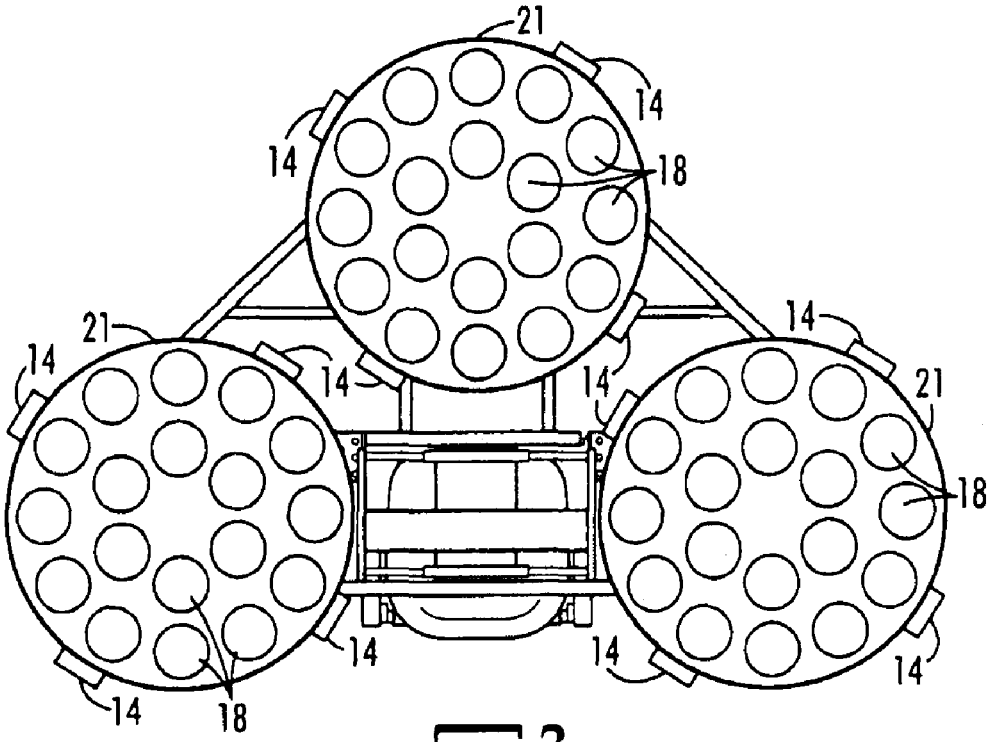
FIG. 3 is a bottom view of the riding trowel of FIGS. 1 and 2 having a large diameter pan releasably attached to the blades of each rotating trowel, with each pan having a plurality of small annular abrading discs.
Figure 4:
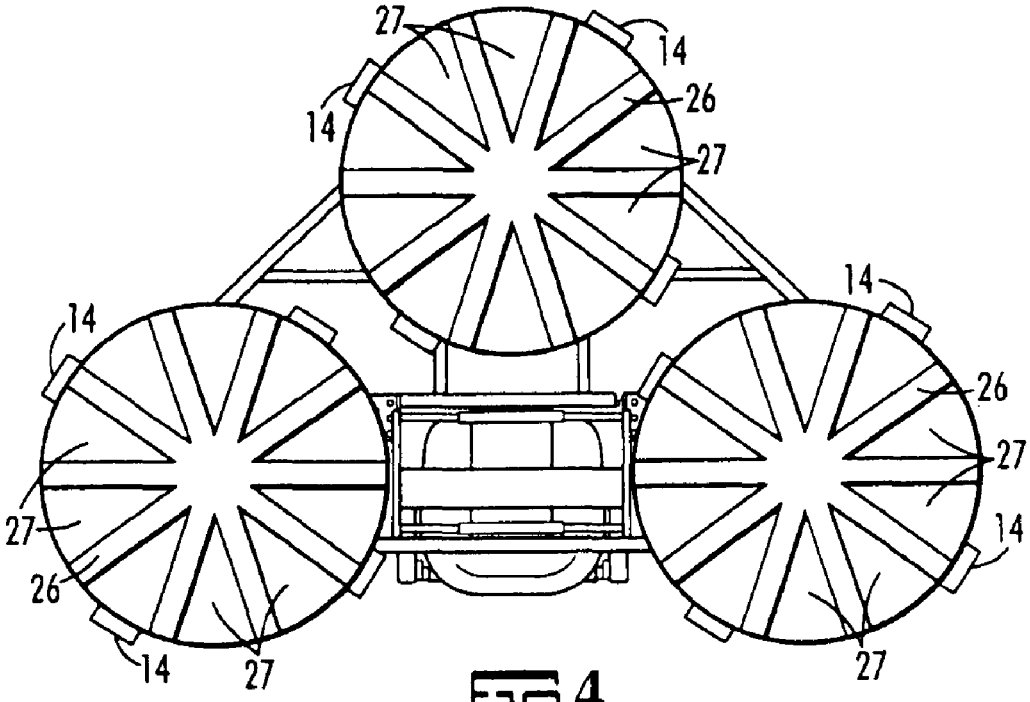
FIG. 4 is a bottom view similar to FIG. 3 but with pie shaped abrading pads attached to the three large diameter pans.

FIGS. 1 and 2 illustrate a riding trowel 11 used in smoothing concrete 12 which has not hardened. FIG. 2 is a bottom view of the riding trowel 11 showing three trowels 13 each having four blades 14. The trowels 13 are driven by three internal combustion engines 16 through vertical shafts 17, respectively. FIG. 3 shows three large pans 21 releasably secured to the blades 14 of the respective trowels 13 by suitable releasable fastening apparatus, not shown. Each pan 21 includes a relatively large number of relatively small diameter annular abraders 18, each of which is releasably fastened to the bottom of the pan 21 by a VELCRO fastener. FIG. 4 shows three large diameter pans 26 releasably secured to the trowel blades 14, the pans having large pie shaped abraders 27 releasably secured to their respective pans 26 by VELCRO fasteners. VELCRO material covers the entire bottoms of the pans 21, 26 and the mating bottoms of the abraders 18, 27.

Figure 5:
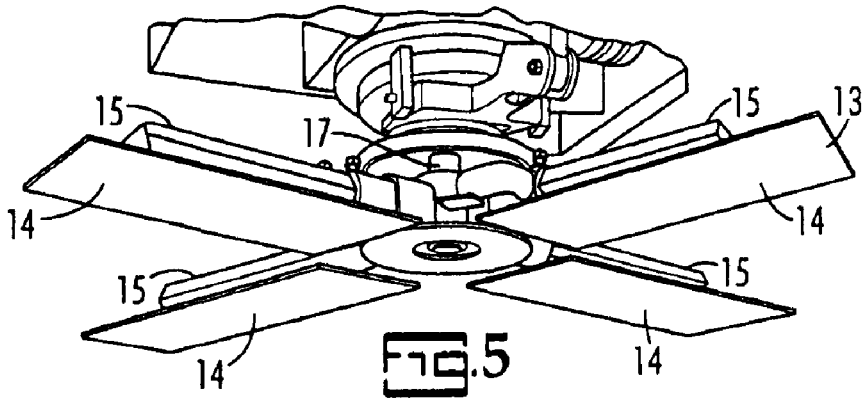
FIG. 5, in a bottom perspective view of one of the three rotatable trowels of the riding trowel shown in FIG. 1.
Figure 6:
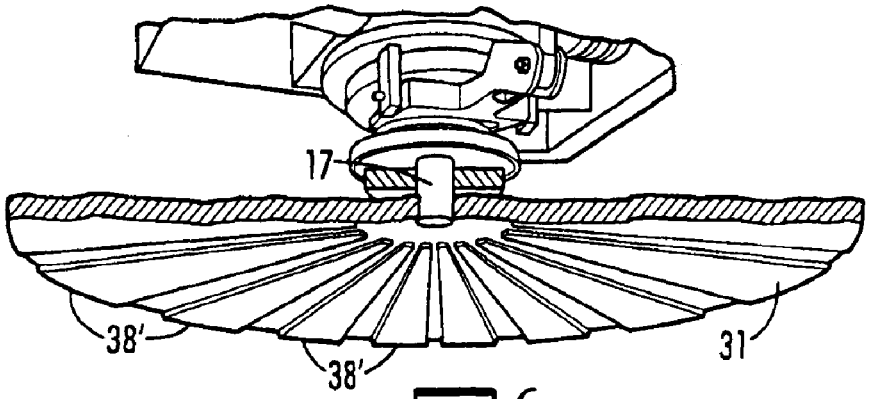
FIG. 6 is a perspective view similar to FIG. 5 but showing a large diameter abrading pan with parts broken away to show its attachment to the trowel drive shaft in place of the four bladed trowel.

FIG. 5 shows a four bladed trowel 13 secured to its vertical drive shaft 17. Each blade 14 is secured to one of the four radially extending support arms 15. FIG. 6 shows a large abrading diameter pan 31 secured for rotation with the drive shaft 17 in place of the trowel 13.

Figure 6A:
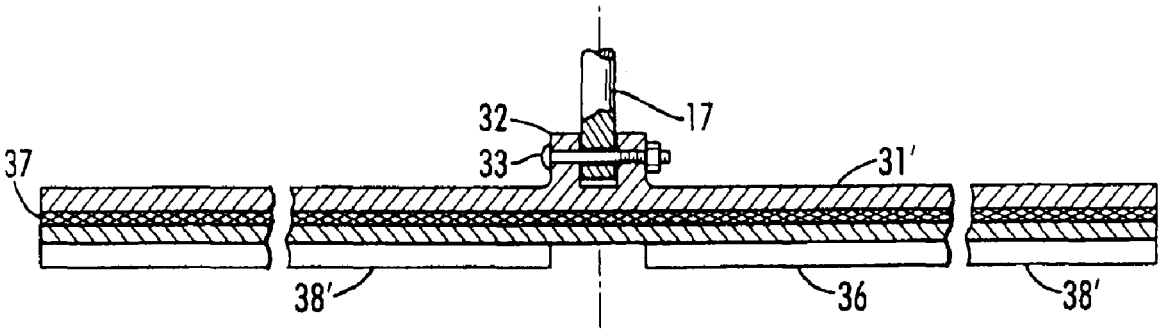
FIG. 6A is a vertical section of the abrading pan of FIG. 6 and its connection to the trowel drive shaft.

FIG. 6A is a vertical section showing an alternate construction with a center hub 32 of a pan 31' secured to the shaft 17 by a bolt 33. A single piece abrading disk 36 is secured to the underside of a pan 31' by VELCRO fastening material 37. The abrading disk 36 includes a plurality of pie shaped abraders 38' molded into the surface of the abrading disk 36.

Figure 7:
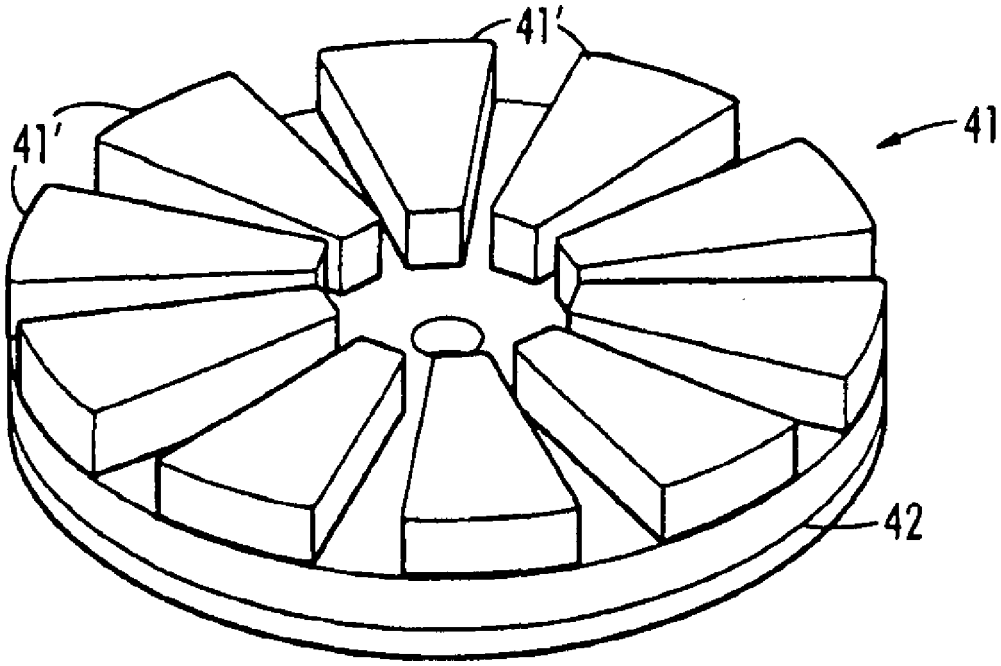
FIG. 7 is a perspective view of a first abrading disk.
Figure 8:
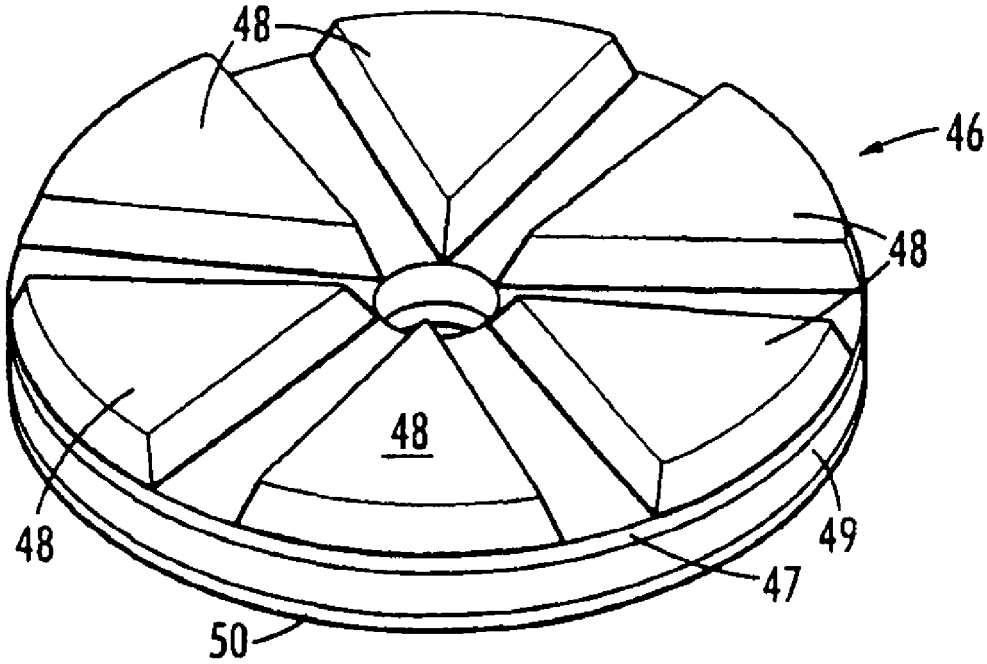
FIG. 8 is a perspective view of a second abrading disk which has abrasives embedded in plastic to provide a consistent abrading surface as the plastic material wears during use.
Figure 9:
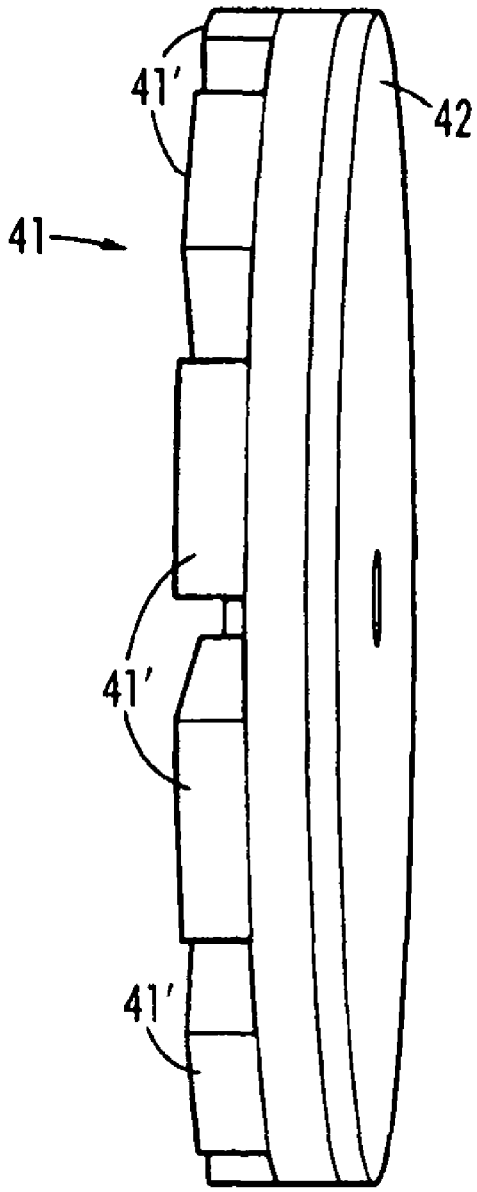
FIG. 9 is a side view of the abrading disc of FIG. 7 showing VELCRO material on its back side.
Figure 10:
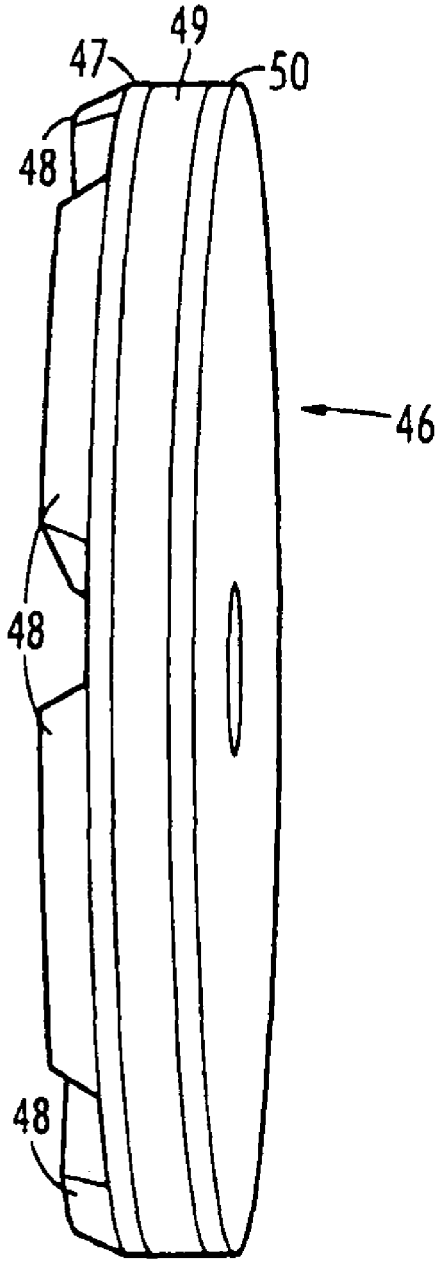
FIG. 10 is a side view of the abrading disc of FIG. 8 showing VELCRO material on its back side.

FIGS. 7 and 9 show a commercially available four inch diameter carbon steel abrading disk 41 having a plurality of circumferentially spaced pie shaped metal abraders 41' with embedded abrading material together with a VELCRO backing 42. FIGS. 8 and 10 show a commercially available 4 inch diameter plastic abrading disk 46 which has embedded grit, not shown, and which includes a plastic annulus 47 having six pie shaped abraders 48. The plastic annulus 47 is rigidly adhered to an annular backing plate 49 and an annular shaped layer of VELCRO material 50 is adhered to the plate 49. These commercially available abraders are designed for attachment to floor polishers to smooth concrete floors; however, the very flat and highly polished surface finish desired by owners of large floor areas, such as found in warehouse type retail stores, can not be achieved using a floor polisher with these small diameter prior-art abrading devices.

Figure 11:
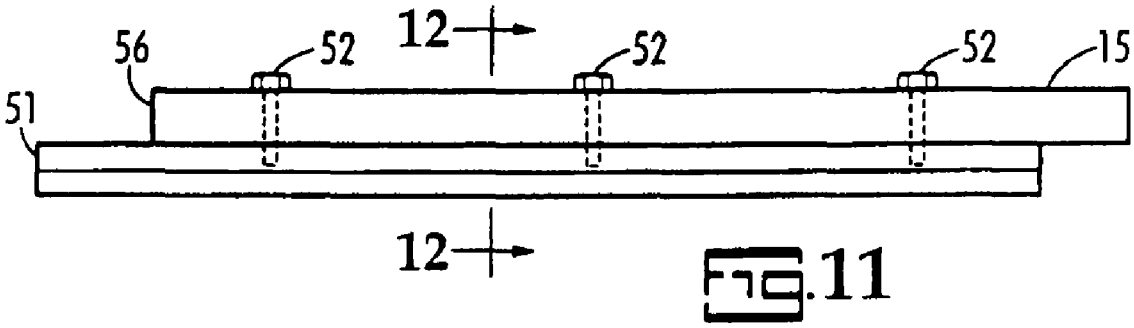
FIG. 11 is a partial side view showing attachment of a plastic blade with embedded abrasing partials connected to a trowel support arm of a riding trowel.
Figure 12:
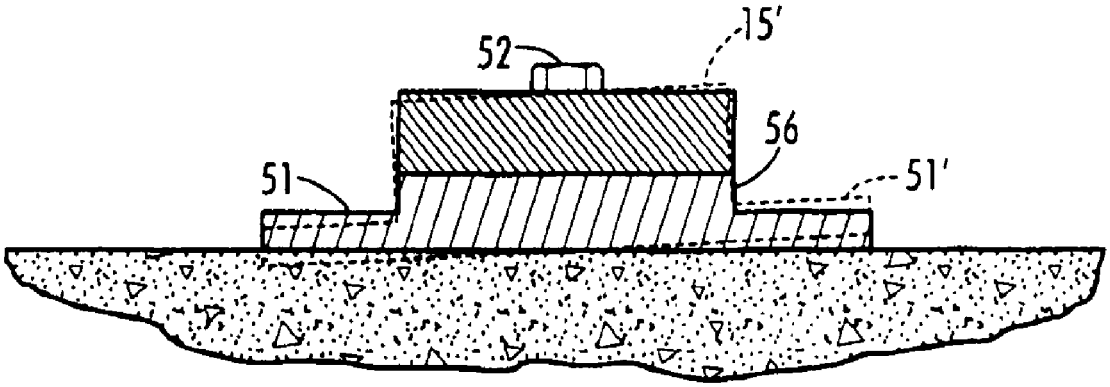
FIG. 12 is a section taken on line 12-12 in FIG. 11.

FIGS. 11 and 12 shows an alternate construction which has been found suitable for polishing concrete floors to a polished finish without exposing course aggregate even though the floor may not be perfectly level. In this alternative construction a plastic polishing blade 51 with embedded diamond dust, or other abrasive, is releasably secured by cap screws 52 to each of the trowel support arms 15 of the riding trowel 11, after the trowel blades 14 have been removed. The polishing blade 51 has a central raised ridge 56 which adds a vertical dimension for the fastening cap screws 52 so they will not engage the floor being polished as the blade 51 wears during use. The plastic blade is resilient, but is sufficiently stiff to ensure bottom surface abrading engagement. The riding trowel is equipped with control apparatus operable to tilt the arms 15 to which the trowel blades are normally secured. Thus the polishing blade 51 can be tilted to a tilted position indicated by broken lines 51' when the arm 15 is titled to its tilted position 15'. The blade 51 is preferably made of a molded plastic material with diamond dust added to the plastic molding compound so that a maximum amount of the surface and thickness of the blade can be used as it wears in use under a range of downward pressure from 1.40 to 2.50 pounds per square inch. The raised section or ridge 56 of the novel molded plastic blade 51 is about 1 to 3 inches wide, and about ¼ to ½ inches thick allowing the screws 52 to attach the blade 51 to the trowel arm 15 extending from the shaft 17 without extending into the portion of the blade 51 that wears away during the expected life of the blade 51.

Figure 13:
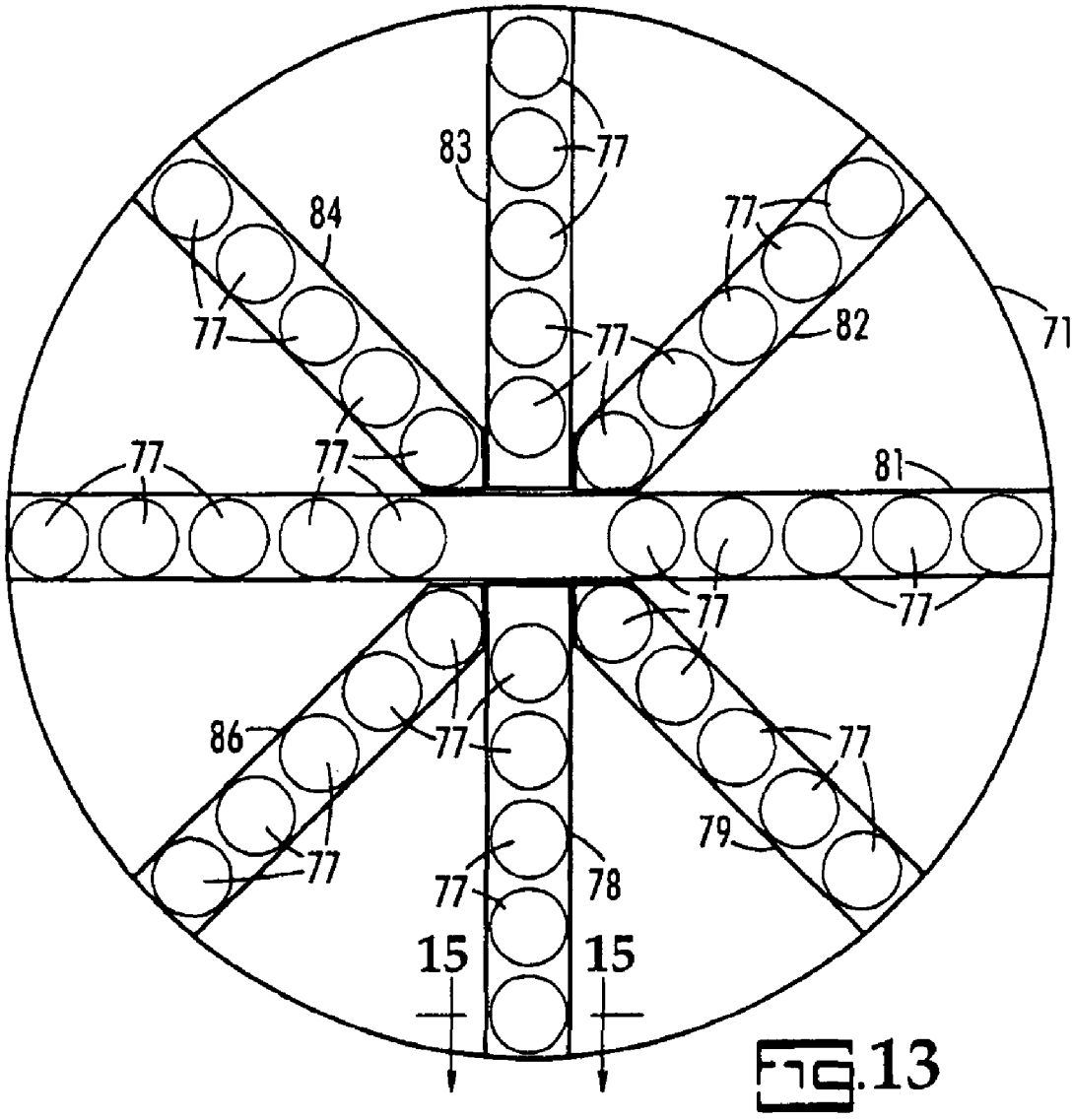
FIG. 13 is a bottom view of a pan showing relatively small round abraders secured to strips on the underside of the pan.
Figure 14:
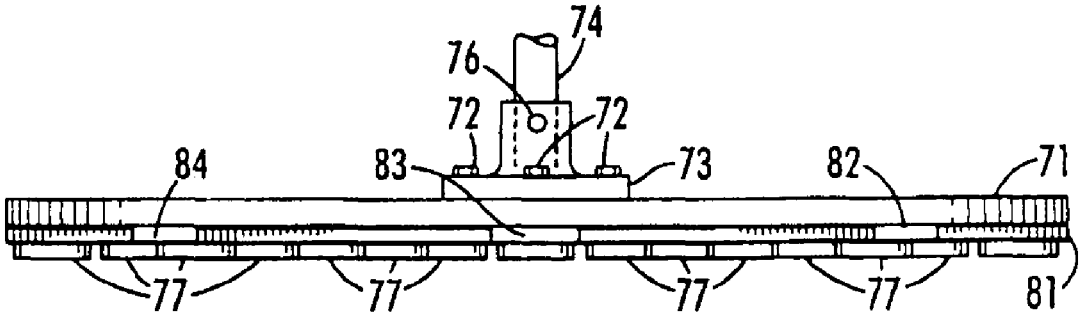
FIG. 14 is a side view of the pan showing its attachment to a riding trowel output shaft.
Figure 15:
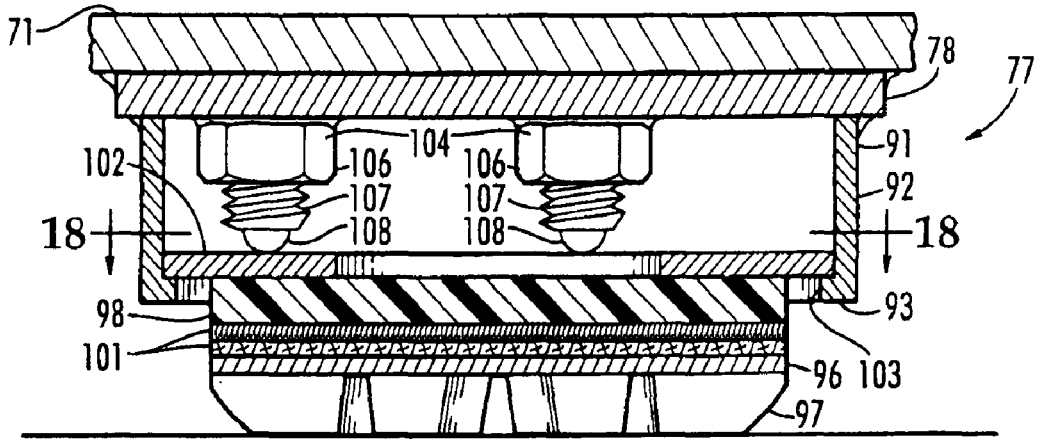
FIG. 15 is a section taken on line 15-15 in FIG. 14 showing details of an abrader, engaging a level segment of a concrete floor.

Referring to FIGS. 13 and 14, a flat rigid annular pan 71 is secured by cap screws 72 to a hub 73 which in turn is secured to a shaft 74 of a riding trowel by a pin 76. A plurality of discs or abraders 77 are mounted to rigid flat metal strips 78, 79, 81, 82, 83, 84, 86 welded to the bottom of the pan 71. The construction detail of the abraders 77 is shown in FIGS. 15-18. Each abrader 77 includes an annular housing 91 having a vertically extending cylindrical wall 92 and a horizontal flange 93 rigidly connected to and extending radially inward from the lower end of the cylindrical wall 92. The upper end of the cylindrical wall 92 is shown welded to the strip 78 which in turn is welded to the pan 71. Each abrader 77 is provided with a resiliently-biased abrader assembly 96 which includes a synthetic annular pad 97 with embedded diamonds, a flat annulus 98, a VELCRO fastener 101 and a back up plate or washer 102. The pad 97 is releasably connected to the flat annulus 98 of hard synthetic material by the VELCRO fastener 101 and the annulus 98 is glued to the metal back up plate or washer 102 whose outer diameter is larger than the diameter of the annular opening 103 defined by the flange 93. Each abrader assembly 96 is resiliently biased downwardly by three thrust transmitting units 104 of each abrader 77, the thrust transmitting unit being illustrated in FIG. 17. The thrust transmitting unit 104 includes an internally threaded nut 106, an externally threaded cylinder 107 having a closed end threadedly engaged in the nut 106, a hard plastic plunger 108 and a biasing coil spring 109 between the upper end of the plunger 108 and the flat horizontal end surface 111 of a cylindrically shaped internal cavity 112 of the threaded cylinder 107. The open or lower end 113 of the cylinder 107 is crimped radially inward forming a radially inward extending ledge 114 against which a radially outward extending shoulder 116 of the plunger 108 rests under the biasing influence of the coil spring 109. Upon the threaded cylinder 107 being threaded into the nut 106 a predetermined extent, it is welded to the nut 106. Three thrust transmitting units 104 are equally spaced circumferentially from one another have their nuts 106 welded to the strip 78 and subsequently the upper end of the annular housing 91 is welded to the strip 78.

Figure 16:
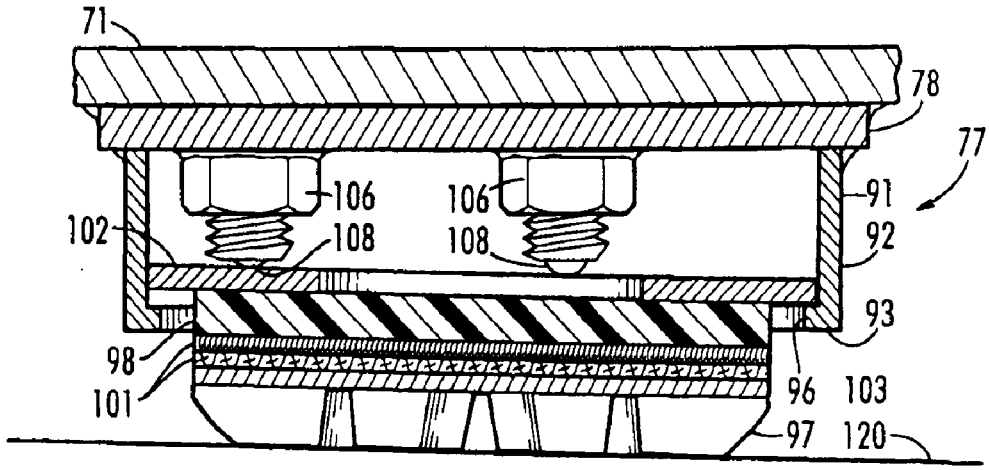
FIG. 16 is a section view similar to FIG. 15 showing a tilted position of the abrader assembly caused by a surface deviation in the concrete floor.
Figure 17:
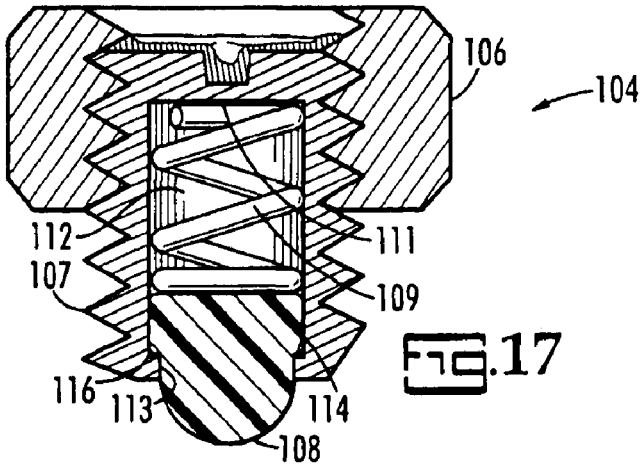
FIG. 17 is a vertical section through one of the three thrust transmitting units in each abrader.
Figure 18:
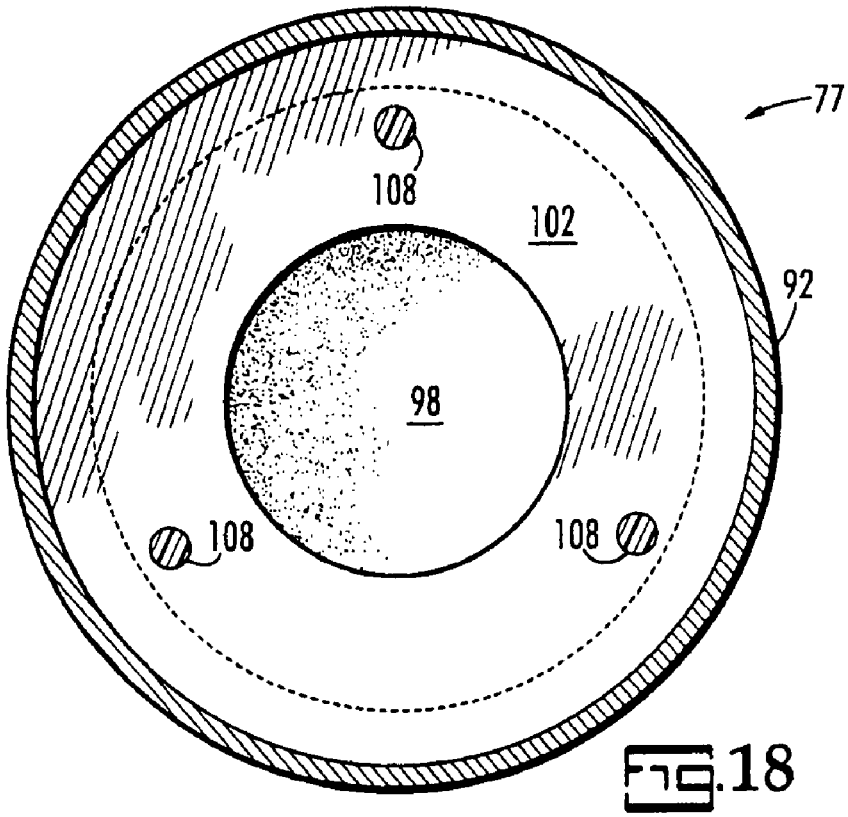
FIG. 18 is a section taken on line 18-18 in FIG. 15.

FIG. 18 shows the three circumferentially spaced plungers 108 bearing downwardly against the plate 102. The weight of the riding trowel 11 acts to cause the plunger 108 to depress a distance into the screw such that the plunger is free to move up or down in response to changes in surface slope. During a concrete finishing operation using the herein discloses method and apparatus, the resiliently biased assemblies 96 maintain the bottom surface of their pads 97 in contact with the concrete surface even though there are some undulations in the concrete surface. Since the pads 97 of the assemblies 96 are biased independently of one another they are able to maintain contact with the floor surface through the minor deviations encountered in concrete floor surfacing operations. Additionally, the three spring loaded thrust transmitting units 104 allow independent tilting of the pads 97, thereby further insuring polishing contact with floor areas having small undulations or other surface irregularities. FIG. 16 shows the abrader 77 traversing a deviation in a concrete floor surface 120. The plunger 108 at the left side of FIG. 16 has been depressed into the screw a greater extent than the plunger on the right side because of the change in surface slope in the deviation. Thus the area of the deviation is effectively abraded to remove surface imperfection and also polished using sets of finer grit abrading pads after application of a surface hardening chemical.

Figure 19:
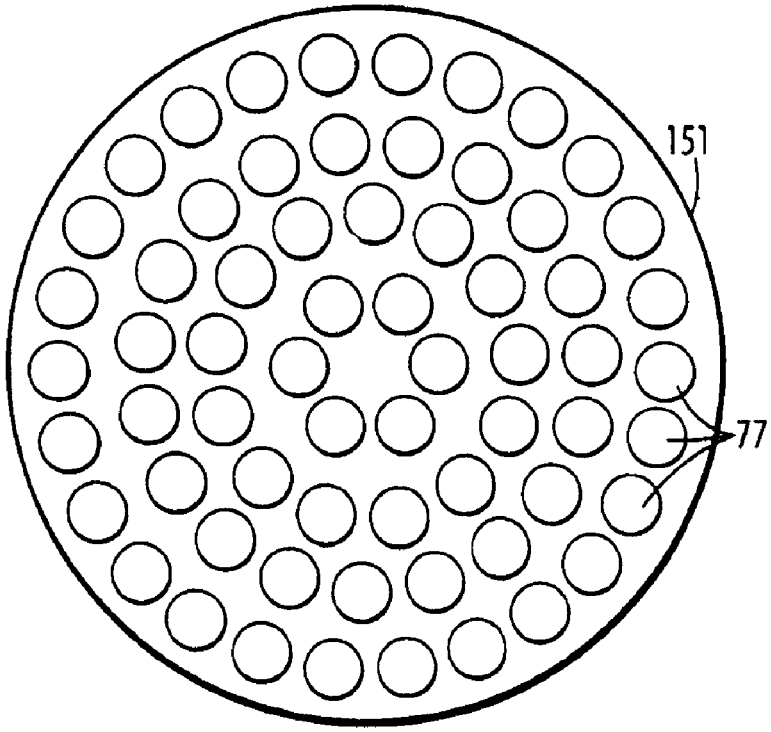
FIG. 19 is a bottom view of a pan with plurality of abraders.

FIG. 19 shows an alternate construction in which a pan 151 has a plurality of assemblies 77 welded to its underside without the intermediate strips 78, 79, 81, 82, 83, 84, 86 shown in FIGS. 13 and 14. The abraders 77 are circumferentially spaced at uniformly spaced intervals, their positions defining concentric circles.

Figure 20:
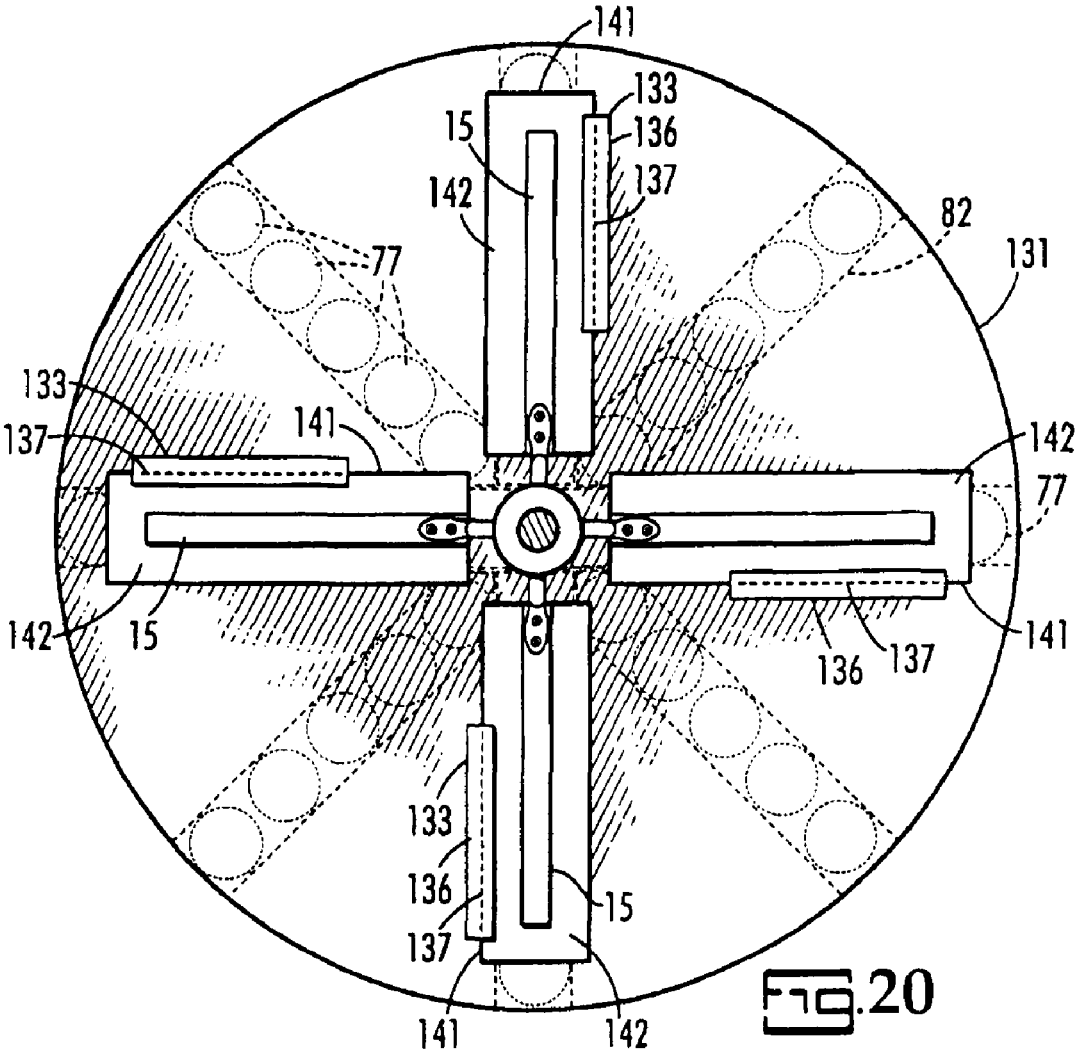
FIG. 20 is a top view of a pan showing trowel support arms lowered for connection with channel members on the back side of a pan.
Figure 21:
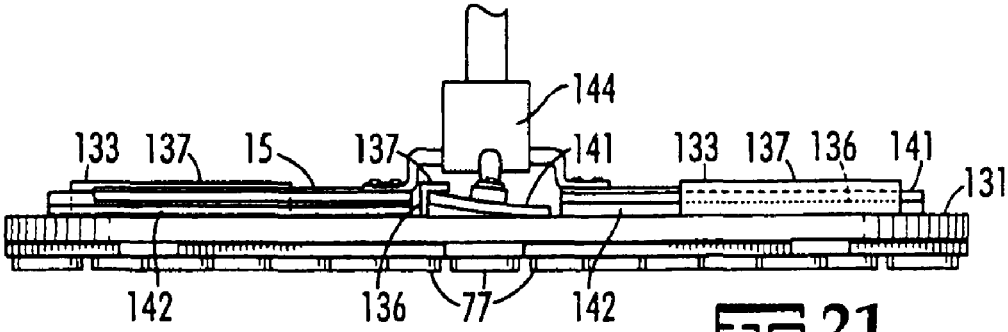
FIG. 21 is a side view of the pan and support arms shown in FIG. 20.

Referring to FIGS. 20 and 21, a pan 131, with a set of abrader assemblies 77 secured to its underside, includes four radially extending angle shaped connectors 133 rigidly secured to its top side. The lower end of the vertical flange 136 of each connector 133 is welded to the top side of pan 131 in a radial position for engagement by the leading edges 141 of the trowel blades 142 when the blade module 144 is lowered onto the top of the pan 131 and then rotated clockwise as viewed in FIG. 20. The horizontally disposed flanges 137 of the angle shaped connectors 133 prevent vertical separation of the pan 131 from the blades 142 of the riding trowel.

The desired surface flatness and high glossy finish are achieved by using large diameter pans to which sets of abrading disks are releasable attached in balanced distribution, such as shown in FIGS. 3, 4, 6, 13, 19, 20 and 21. These large diameter abrading tools require application of an appreciable amount of downward force to remove the optimum amount of surface concrete and to achieve the desired flatness. The riding trowel has been found to be a suitable type machine to which such large diameter pans, or large diameter grinding/polishing disks can be secured either to the trowel blades as shown in FIGS. 3, 4, 20 and 21 or to the trowel blade drive shafts as shown in FIGS. 6, 6A and 14. The use of large diameter pans with a plurality of abraders, and substantially equal weight distribution on the abrading surfaces contributes to forming a finished surface on fully cured concrete which is very flat and highly polished with a compressive strength between 3000 and 6000 pounds per square inch. Suitable riding trowels are currently manufactured by several companies including Whiteman Company and Allen Company. Using a 60 inch diameter pans presenting abrading surfaces covering one half their underside areas, it has been found that between 2000 and 3500 pounds of weight needs to be applied to each pan, which translates to between 1.40 and 2.50 pounds per square inch of downward force being applied to the concrete surface by the abrading surfaces.

After the concrete floor has been poured, troweled and hardened, the finishing process begins in which progressively finer grit floor finishes are developed. The floor is abraded and polished in sequential steps using sets of abraders having progressively finer grit. The sequence of flattening and polishing the concrete is critical to achieving the desired degree of surface smoothness and high gloss. The sequence of steps in a preferred embodiment is to spray water on the floor and start with a set of abraders having a 50 grit diamond surface followed by one or more grinding passes using sets of abraders with progressively finer grits to about 400 grit. Water is preferably applied to the concrete surface prior to each flattening step and the floor is preferably vacuumed after abrading and prior to the next step. A standard liquid removal machine may be used to vacuum up the foreign material which typically includes water which is mixed with concrete dust and abrader particles as a result of the flattening step. The concrete surface is then allowed to dry.

Next a suitable liquid hardener such as the Diamond Hard marketed by Euclid Chemical may be applied, as by spraying, to the surface of the concrete. Excess liquid is removed, as by vacuum. The surface of the concrete is allowed to dry. The next polishing steps employ the large rotating circular pans with sets of abraders or a single large diameter abrader disk. The floor polishing is achieved by using sets of progressively finer grit abraders selected from the grit sizes between 400 and 3,500 grit. The floor surface is vacuumed after each step to remove liquid and powder. The liquid hardener makes the surface of the concrete very hard and durable. If a liquid chemical is not used, the above steps of using sets of abraders with progressively finer grits selected from between 400 and 3,500 must still be performed to achieve the desired degree of surface smoothness and gloss of the concrete surface. The end result is a very smooth and high gloss surface.

In the concrete finishing process, the total amount of concrete that will be removed from the original concrete surface will be less than ⅛ inch. The surface finish method does not grind into the aggregate which after troweling poured concrete is normally at least ⅛ inch below the floor surface. The purpose of the progressive increase in the grit number is to reduce the surface porosity of the concrete. If a chemical is used, it is applied following the grind using the first plurality of sets of 50 to 400 grit surfaced abraders in order for the chemical to be able to soak easily into the surface of the concrete. If the porosity of the concrete is too low, the chemical will not soak in properly.

One of the most significant benefits of this new technology is the ability to achieve a highly polished concrete surface. This is achieved by using relatively large diameter rotating pans with sets of abraders to which sufficient downward force is applied to remove surface defects, oil spots, battery acid, tire marks and the like. The pan may be 24 to 86 inches in diameter. Attaching the sets of abraders to the pan by VELCRO material makes it easy and less time consuming to progressive change the abraders during the sequential steps in finishing the floor. Also, excessively worn abraders can be replaced without replacing the pan. The VELCRO connection saves time in switching between sets of coarse abraders with diamond chips embedded in their surface for relatively coarse finishing and in switching between sets of abraders with embedded fine grit for high polish finishing.

A pan with flattening or polishing sets of abraders can be connected either to the trowel blades of each trowel or to one of the vertical trowel blade drive shafts of a riding trowel machine. The spring biased abrader assemblies 77 are particular advantageous in sequentially polishing the floor with the second plurality of sets of abraders having for instance 400, 800, 1,500 and 3,500 grit, respectively. However abrader pads of the first plurality of sets of abraders, with 4 to 400 grit can also be advantageously used in the spring biased abrader assemblies 77.

The steps to follow in practicing the inventive method on a concrete surface that has been allowed to fully cure for the full 28 days can be summarized as follows:

1. Spray or otherwise apply water to the surface of the fully cured concrete.

2. Using a riding toweling machine grind off a small thickness (less than ⅛") of the surface of the concrete in the following manner:

a. Use a 24 to 86 inch diameter pan with sets of abraders from a first plurality of sets of abraders having a grit surface between 50 and 400 grit. The rpm of the pan should be between 150 and 200 and the downward thrust of the pan on the floor should be between 1.4 and 2.5 pounds per square inch.

b. After abrading with each set, vacuum up the water and concrete powder that has been generated. Allow the surface to dry and then spray water on the concrete surface.

3. If a liquid hardening chemical is used, it is next applied as by spraying a measured amount onto the concrete surface. The chemical hardening solution should be allowed to penetrate into the pores of the concrete and to cure. If the hardening solution dries too quickly water is sprayed on the concrete surface to insure penetration of the chemical into the floor surface. After the chemically treated concrete has dried, spray water on the surface of the concrete. Then polish the concrete using a second plurality of sets of progressively finer grit surface abraders within the range of 400 to 3,500 grit using the riding trowel machine to which the correct amount of weight has been added to give the required amount of downward force. After each abrading step the concrete surface is vacuumed to remove foreign particles.

Figure 22:
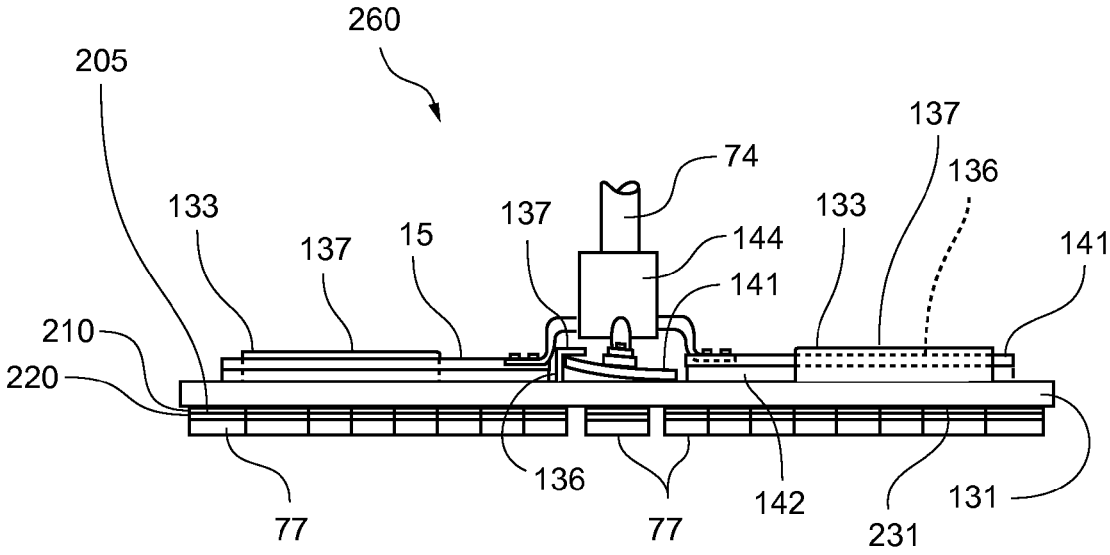
FIG. 22 is a side cross-sectional view of an annular pan secured to trowel blades, showing abrading pads secured to the bottom surface of the annular pan.
Figure 23:
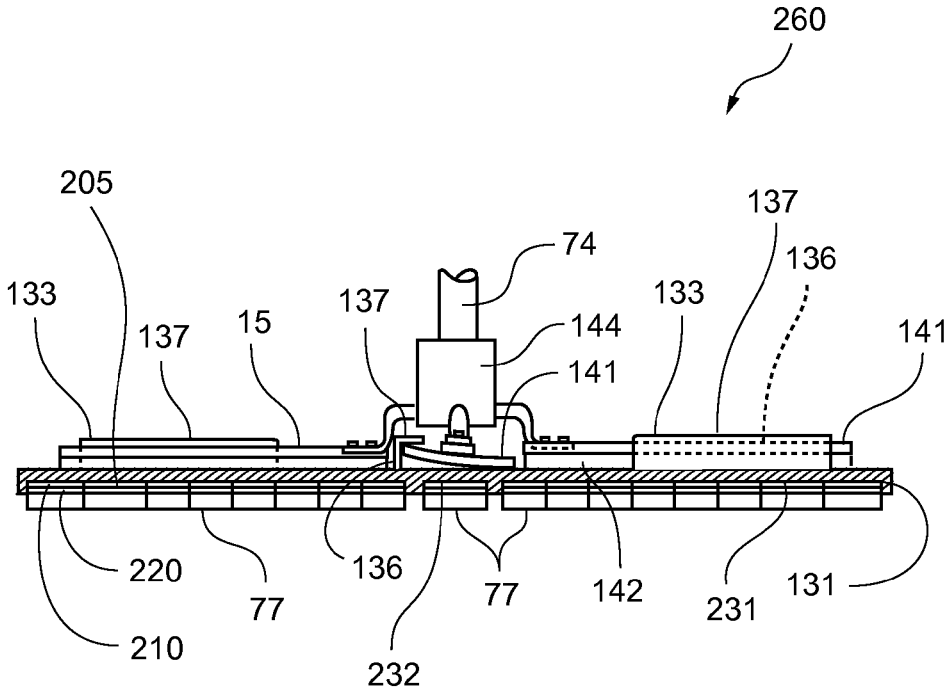
FIG. 23 is a side cross-sectional view of an annular pan secured to trowel blades, showing abrading pads recessed into the bottom surface of the annular pan.

Turning now more particularly to FIGS. 22 and 23, depicted therein are alternate embodiments of trowels 260, illustrating attachment of abraders 77 to annular pan 131. In the alternate embodiment of FIG. 22, abraders 77 are secured to bottom surface 231 of annular pan 131 via cooperative hook-and-loop fasteners 205 directly, wherein first halves 210 of cooperative hook-and-loop fasteners 205 are secured to bottom surface 231 of annular pan 131, and wherein second halves 220 of cooperative hook-and-loop fasteners 205 are secured to individual abraders 77. In such fashion, individual abraders 77 can be readily removed and new abraders 77 can be secured to annular pan 131.

In the alternate embodiment depicted in FIG. 23, first halves 210 of cooperative hook-and-loop fasteners 205 are secured within depressions 232 in bottom surface 231 of annular pan 131, wherein second halves 220 of cooperative hook-and-loop fasteners 205 are secured to first halves 210 within depressions 232, thereby providing a slight recess of abraders 77 and improved containment thereof when subject to lateral forces during operation.

Figure 24:
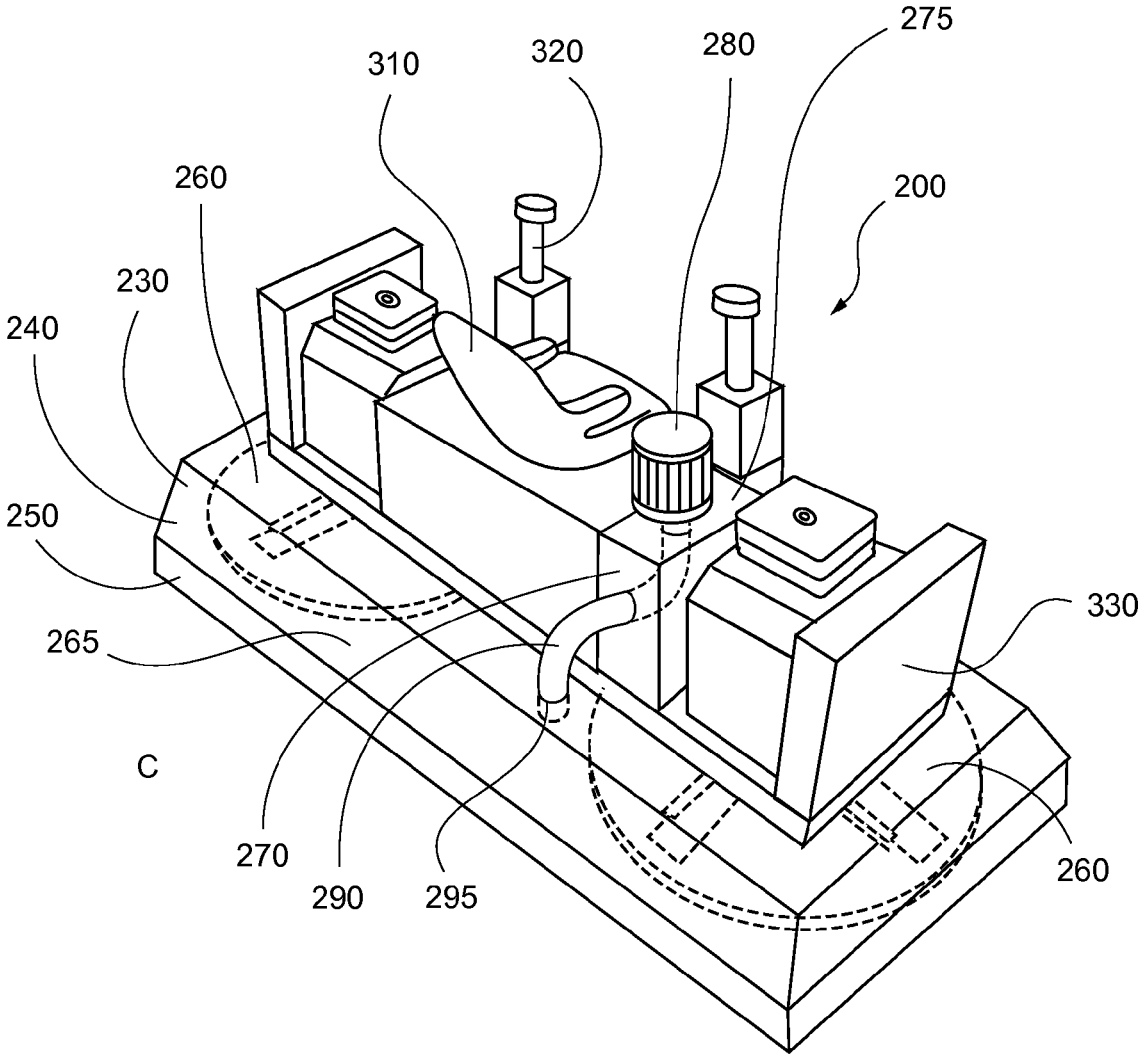
FIG. 24 is a rear perspective view of a shrouded riding trowel having two large diameter annular pans.
Figure 25:
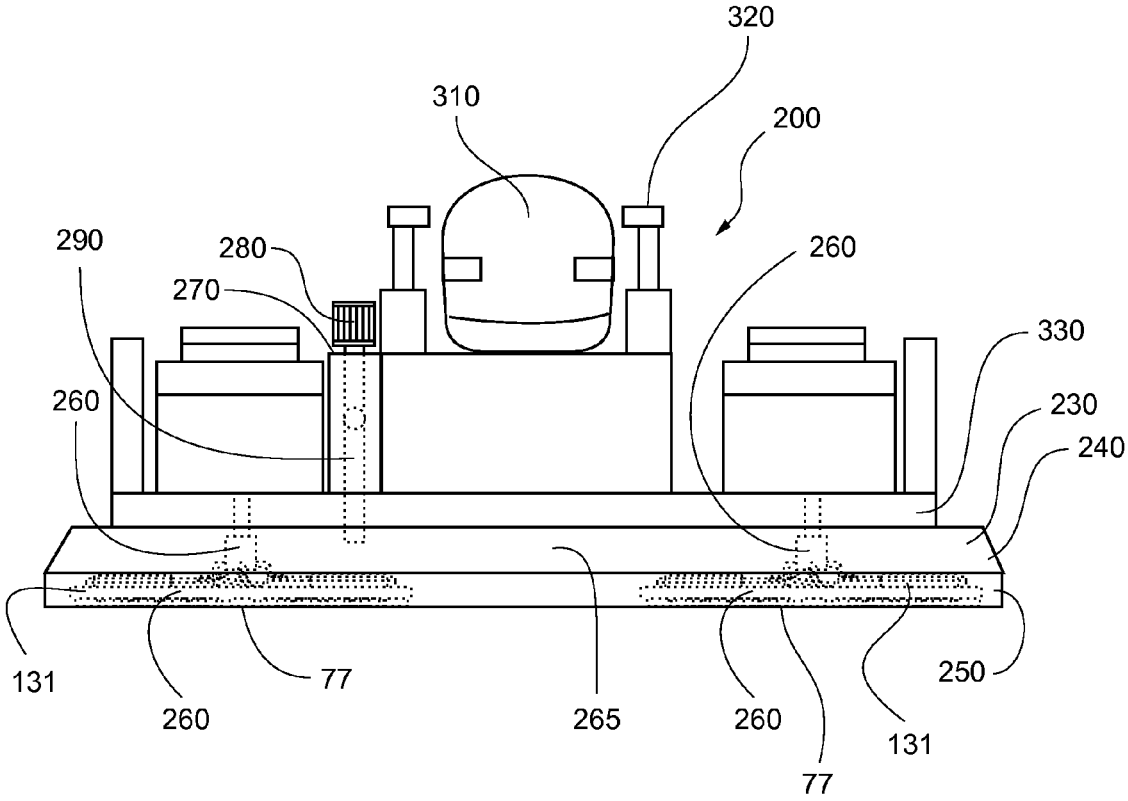
FIG. 25 is a front view of the shrouded riding trowel depicted in FIG. 24.

Turning now to FIGS. 24 and 25, illustrated therein is an alternate embodiment comprising riding trowel 200, wherein the alternate embodiment of FIGS. 24 and 25 is substantially equivalent in form and function to that of the preferred embodiment detailed and illustrated in FIG. 1 except as hereinafter specifically referenced. Specifically, the embodiment of FIGS. 24 and 25 comprises riding trowel 200, wherein riding trowel 200 comprises two abrading mechanisms, or trowels 260. It will be recognized by those skilled in the art that riding trowel 200 could comprise any number of abrading mechanisms 260, such as, for exemplary purposes only, three abrading mechanisms, as depicted in the embodiment shown in FIG. 1.

Riding trowel 200 further comprises shroud 230, wherein shroud 230 comprises upper rigid section 240 and lower flexible section 250. Upper rigid section 240 is made from metal or rigid plastic while lower flexible section 250 is made from rubber or flexible plastic. Lower flexible section 250 contacts floor surface C forming a loose seal around contained space 265, wherein contained space 265 is enclosed by platform 330, shroud 230 and floor surface C, wherein platform 330 comprises seat 310 and controls 320.

Vacuum system 270 is selectively installed on riding trowel 200, wherein vacuum system 270 comprises vacuum motor 275, filter 280 and tube 290, wherein tube 290 is in fluid communication with contained space 265 by entry through shroud 230 via aperture 295. It will be recognized by those skilled in the art that vacuum system 270 could be stationery and external to riding trowel 200 without departing from the spirit of this alternate embodiment. In such case, vacuum system 270 would still be in fluid communication with contained space 265 via tube 290, wherein tube 290 provides fluid communication between external vacuum system 270 and contained space 265.

In use, abraders 77 having second halves 220 of cooperative hook-and-loop fasteners 205 secured thereto, are removably secured to first halves 210, wherein first halves 210 have previously been secured to bottom surface 231 of annular pan 131, selectively either directly on bottom surface or within depressions 232. Annular pans 131 are installed on trowel blades 142 (best shown in FIGS. 22-23) as described more fully hereinabove.

Vacuum system 270 applies a vacuum to contained space 265 within shroud 230. Riding trowel 200 is operated on cured concrete surface C for finishing of same, wherein annular pans 131 are rotated, abrading the concrete surface C. Detritus from the abrasion operation is removed by vacuum system 270 and collected in filter 280 for subsequent disposal.

Figure 26:
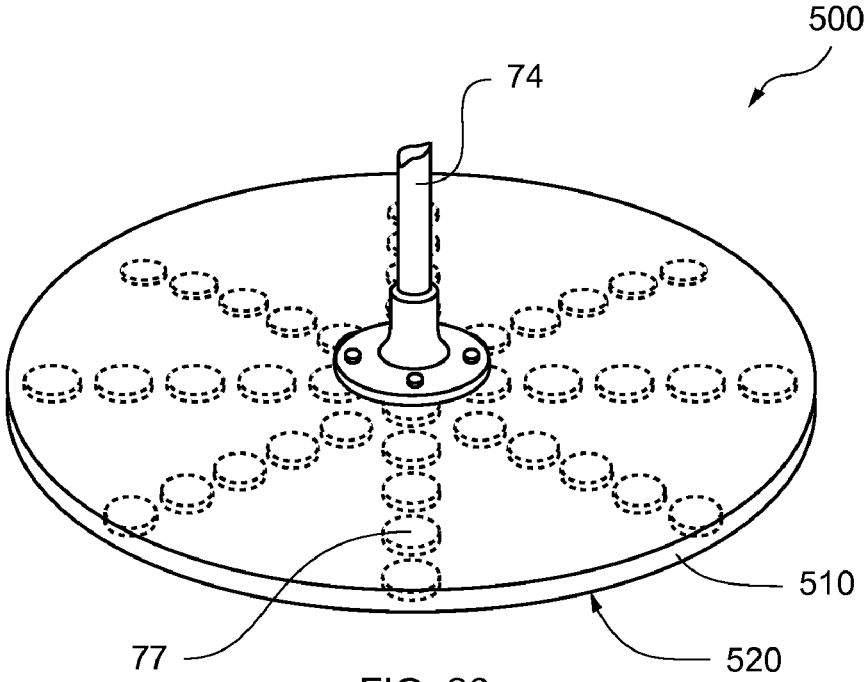
FIG. 26 is a perspective view of a directly-driven disk-shaped abrader substrate according to an alternate embodiment, showing abrading pads on a bottom surface thereof.

Turning now to FIG. 26, depicted therein is alternate embodiment abrader 500, wherein abrader 500 comprises circular disk 510, and wherein circular disk 510 comprises bottom surface 520 with abrader pads 77 disposed thereon. Abrader 500 is directly driven by shaft 74.

Figure 27:
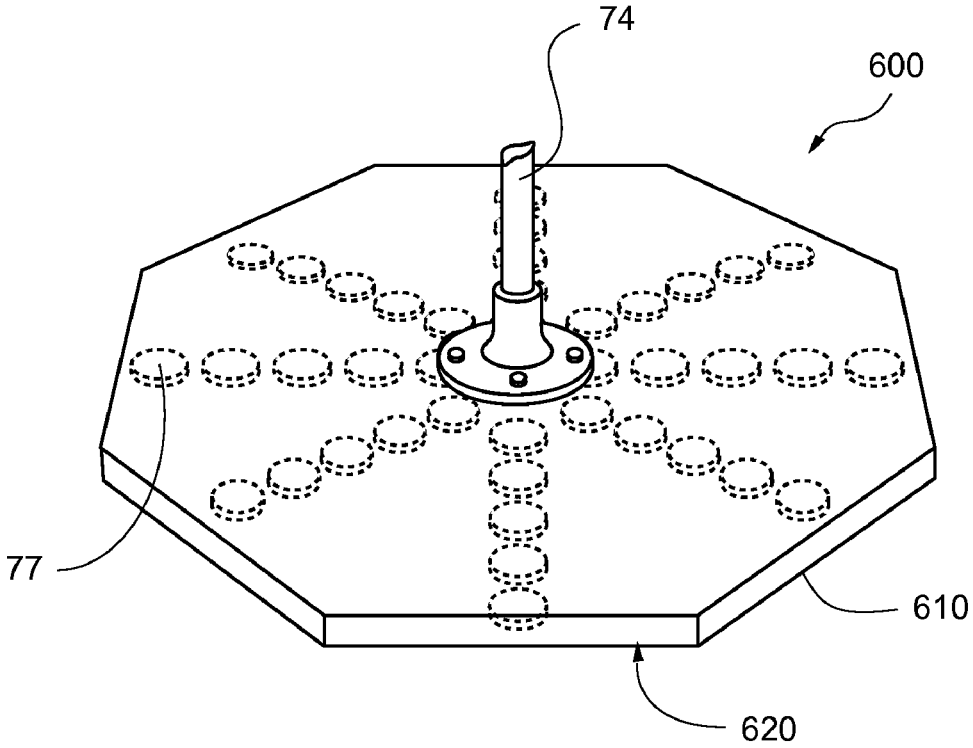
FIG. 27 is a perspective view of a directly-driven octagonal-shaped abrader substrate according to an alternate embodiment, showing abrading pads on a bottom surface thereof.

Turning now to FIG. 27, depicted therein is alternate embodiment abrader 600, wherein abrader 600 comprises octagonal disk 610, and wherein octagonal disk 610 comprises bottom surface 620 with abrader pads 77 disposed thereon. Abrader 500 is directly driven by shaft 74. It will be recognized by those skilled in the art that other shapes than circular (as depicted in FIG. 26) or octagonal (as depicted in FIG. 27) could be utilized. Such could include, without limitation, square, triangular and other polygonal shapes.

Figure 28:
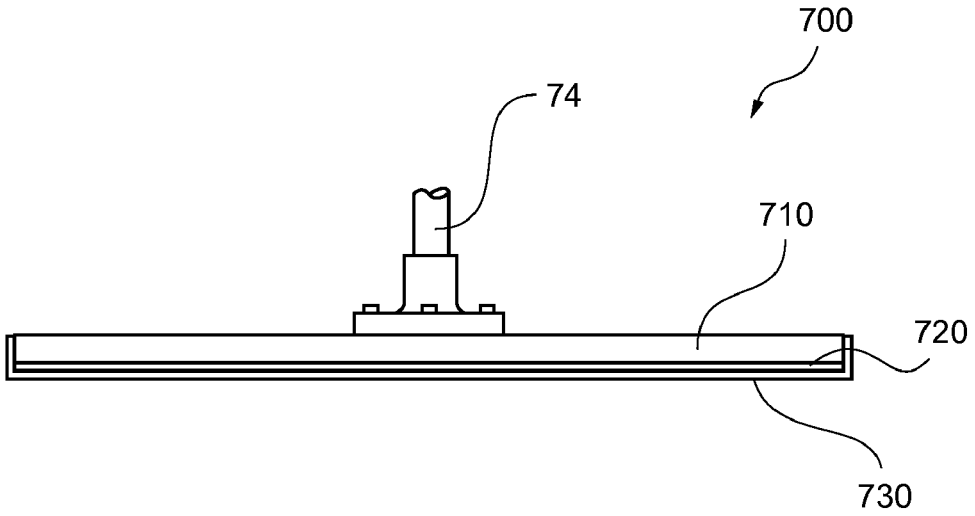
FIG. 28 is a side cross-sectional view of an abrading pan secured to a directly-driven disk-shaped substrate according to an alternate embodiment.

Turning now to FIG. 28, depicted therein is alternate embodiment abrader 700, wherein abrader 700 comprises substrate 710, driven by shaft 74. Abrading pan 730 is removably secured to substrate 710 via hook-and-loop fasteners 720.

Figure 29:
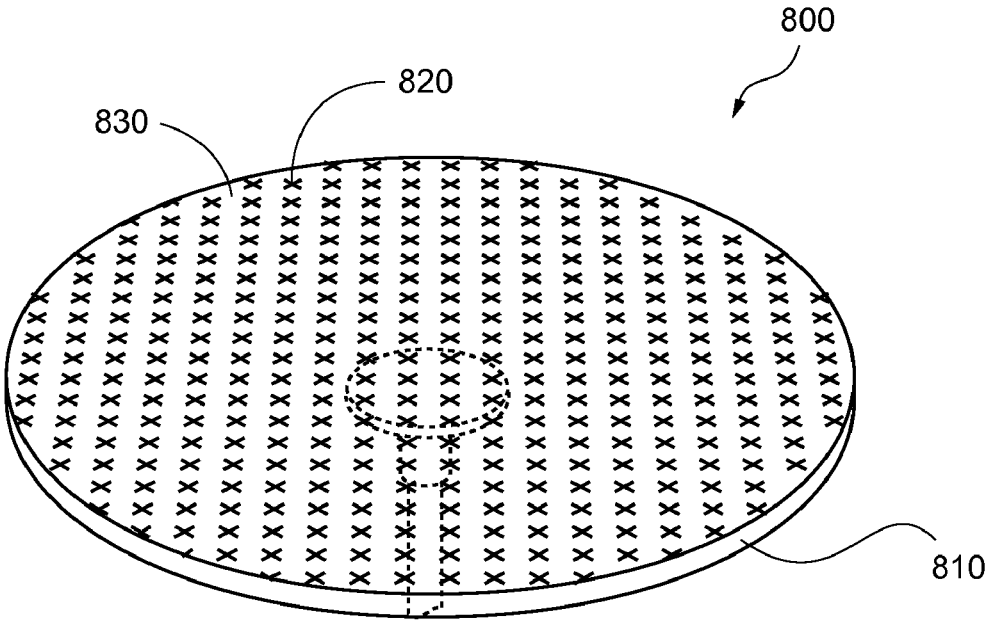
FIG. 29 is a directly-driven disk-shaped diamond abrader according to an alternate embodiment.

Turning now to FIG. 29, depicted therein is alternate embodiment diamond abrader 800, wherein diamond abrader 800 comprises diamond-impregnated disk 810, and wherein diamond-impregnated disk 810 comprises bottom surface 830 having diamond abrasive material 820 imbedded therein. Diamond abrader 800 provides a wearable surface that constantly exposes new diamond abrasive material 820 with continued use. Diamond abrasive material 820 could selectively be replaced with other abrasive matter suitable for smoothing cured concrete, without departing from the spirit of this alternate embodiment.

Abraders 500, 600, 700, 800 are utilized by replacement by same of abrading mechanisms 260 (best depicted in FIGS. 24 and 25).

The embodiments shown in FIGS. 13-29 are advantageous in finishing and polishing newly laid concrete floors and in fully polishing older concrete floors from which surface material cannot be removed from high spots without exposing stone aggregate. The abraders follow the floor contour to smooth and polish the floor surface without exposing stone aggregate. A smooth polished satin finish can be achieved on an old concrete floor similar to that achieved when using the same equipment in finishing freshly cured concrete, provided the floor surface is reasonably flat.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. An abrading apparatus for a concrete finishing trowel, said abrading apparatus comprising:

a pan;

at least one abrading pad; and at least one fastener for removably securing said at least one abrading pad to said pan, wherein said fastener comprises a hook-and-loop fastener, and wherein a first portion of said hook-and-loop fastener is secured to said pan, and wherein a second portion of said hook-and-loop fastener is secured to said at least one abrading pad, and wherein said pan further comprises a bottom surface and at least one shallow depression in said bottom surface, and wherein said first portion of said hook-and-loop fastener is secured to said pan within said shallow depression.

2. The abrading apparatus of claim 1, wherein said second portion is secured to said first portion.

3. The abrading apparatus of claim 1, wherein said abrading apparatus is installed on said concrete finishing trowel.

4. The abrading apparatus of claim 3, wherein a second abrading apparatus is installed on said concrete finishing trowel.

5. The abrading apparatus of claim 4, wherein said concrete finishing trowel comprises a shroud dimensioned to enclose said abrading apparatus and said second abrading apparatus to form a contained space.

6. The abrading apparatus of claim 5, wherein said shroud comprises a rigid upper section and a flexible lower section, and wherein said flexible lower section loosely forms a seal against a ground surface during operation of said concrete finishing trowel.

7. The abrading apparatus of claim 5, further comprising a vacuum system in fluid communication with said contained space within said shroud.

8. The abrading apparatus of claim 1, wherein said pan is secured to blade portions of a concrete finishing trowel.

9. A method of finishing a concrete surface, said method comprising the steps of:

obtaining a concrete finishing trowel comprising at least one pan rotationally secured thereto, wherein said at least one pan comprises a shallow depression and at least one abrader, and wherein said at least one abrader is removably secured by a fastener disposed within said shallow depression, and wherein said concrete finishing trowel further comprises a shroud having a rigid upper section and a flexible lower section, and wherein said flexible lower section is in communication with the ground surface; and polishing said concrete surface by rotation of said at least one pan, wherein said at least one abrader is in contact with said concrete surface.

10. The method of finishing a concrete surface of claim 9, wherein said shroud forms a contained space around said at least one pan, and wherein said concrete finishing trowel further comprises a vacuum system, said method further comprising the step of:

removing detritus within said contained space by applying a vacuum to said contained space.

11. The method of finishing a concrete surface of claim 10, said method further comprising the step of:

filtering air removed by said vacuum system.

12. A concrete finishing apparatus comprising:

a platform having an operator control area thereon;

a shroud extending from said platform to a ground surface to be finished, wherein said shroud, said platform and the ground surface cooperatively form a contained space, and wherein said shroud comprises a rigid upper section and a flexible lower section, and wherein said flexible lower section is in communication with the qround surface;

at least one pan having at least one abrader removably secured thereto, wherein. said at least one pan is rotationally secured to a drive mechanism of said concrete finishing apparatus, and wherein said at least one pan is disposed within said contained space, and wherein said at least one pan comprises a shallow depression and wherein said at least one abrader is secured by a fastener disposed within said shallow depression, and wherein said fastener comprises a hook-and-loop fastener; and a vacuum mechanism, wherein said vacuum mechanism is in fluid communication with said contained space.

* * * * *